US010065434B2

(12) United States Patent
Motoyama et al.

(10) Patent No.: US 10,065,434 B2
(45) Date of Patent: Sep. 4, 2018

(54) PRINTING DEVICE AND CONTROL METHOD OF A PRINTING DEVICE

(71) Applicant: Seiko Epson Corporation, Tokyo (JP)

(72) Inventors: Hiroyuki Motoyama, Shiojiri (JP); Hideki Nishimura, Matsumoto (JP); Satoshi Omoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/235,594

(22) Filed: Aug. 12, 2016

(65) Prior Publication Data

US 2017/0043597 A1 Feb. 16, 2017

(30) Foreign Application Priority Data

Aug. 13, 2015 (JP) ..... 2015-159838
Aug. 13, 2015 (JP) ..... 2015-159845

(51) Int. Cl.
*B41J 11/00* (2006.01)
*B41J 3/54* (2006.01)

(52) U.S. Cl.
CPC ..... *B41J 11/002* (2013.01); *B41J 3/543* (2013.01)

(58) Field of Classification Search
CPC ..... B41J 15/04; B41J 15/042; B41J 15/044; B41J 15/046; B41J 15/048; B41J 11/0025; B41J 11/003; B41J 11/0045
See application file for complete search history.

(56) References Cited

U.S. PATENT DOCUMENTS

2006/0269348 A1* 11/2006 Nagata ..... B41J 11/0095 400/615.2
2010/0026738 A1* 2/2010 Saikawa ..... B41J 3/4075 347/1
2010/0111546 A1* 5/2010 Kubo ..... G03G 15/6508 399/16
2010/0238225 A1* 9/2010 Igarashi ..... B41J 11/001 347/16
2012/0267468 A1* 10/2012 Shiode ..... B41J 11/003 242/419.8

(Continued)

FOREIGN PATENT DOCUMENTS

JP 04-156061 A 5/1992
JP 04-077471 U 7/1992

(Continued)

*Primary Examiner* — Geoffrey Mruk
*Assistant Examiner* — Scott A Richmond
(74) *Attorney, Agent, or Firm* — Nutter McClennen & Fish LLP; John J. Penny, Jr.

(57) ABSTRACT

A printing device has a print unit that prints on roll paper; a storage compartment that holds roll paper; a paper guide that limits the position of the roll paper in the storage compartment; a paper guide sensor that outputs different detection values according to the status of the paper guide; a memory unit that stores the paper width of the roll paper; and a control unit that causes the print unit to print based on the paper width stored by the memory unit, detects the status of the paper guide based on the detection value of the paper guide sensor when triggered by a specific event, changes the paper width setting to a value indicating 58 mm if the paper guide is installed, and to a value indicating 80 mm if the paper guide is not installed.

13 Claims, 9 Drawing Sheets

(56) References Cited

U.S. PATENT DOCUMENTS

| | | | | |
|---|---|---|---|---|
| 2013/0170848 | A1* | 7/2013 | Hirota | B65H 19/12 399/45 |
| 2013/0183075 | A1* | 7/2013 | Kim | B41J 11/0025 400/619 |
| 2014/0209655 | A1* | 7/2014 | Haque | B65H 23/0204 226/15 |
| 2015/0346664 | A1* | 12/2015 | Tanaka | G03G 15/502 399/81 |

FOREIGN PATENT DOCUMENTS

| | | | |
|---|---|---|---|
| JP | 2003-226440 | A | 8/2003 |
| JP | 2004-133259 | A | 4/2004 |
| JP | 2006-189624 | A | 7/2006 |
| JP | 2009-286102 | A | 12/2009 |
| JP | 2013-216395 | A | 10/2013 |
| JP | 2015-114882 | A | 6/2015 |

* cited by examiner

PRINTING DEVICE AND CONTROL METHOD OF A PRINTING DEVICE

This application claims priority under 35 U.S.C. § 119 to Japanese Patent Application No. 2015-159838 filed on Aug. 13, 2015, and No. 2015-159845 filed on Aug. 13, 2015, the entire disclosure of which is expressly incorporated by reference herein.

BACKGROUND

1. Technical Field

The present disclosure relates to a printing device and a control method of a printing device.

2. Related Art

Printing devices (recording paper width detection devices) that hold roll paper, have a paper guide (divider) that determines the position of recording paper having different widths, and detects the width of the roll paper by a sensor that detects the location of the paper guide, are known from the literature. See, for example, Publication of utility model application JP-U-04-077471.

By detecting the paper width based on the output value of the sensor at a specific timing, the printing device can suppress power consumption and detect the paper width efficiently. The printing device records a setting indicating the detected paper width in a configuration file, and executes the printing process based on the paper width setting. Due to the time lag between the timing when the paper width is detected based on the sensor output, and the timing when the paper guide is set, the paper width indicated by the setting and the paper width of the roll paper actually installed in the printing device may not match. Because the printing device runs the printing process based on this setting, printer mechanisms and printing results may be adversely affected due to the mismatching values if the printing process is executed when the paper width indicated by the stored setting and the paper width of the roll paper actually installed in the printing device do not match.

Printing devices such as this typically connect to an external device and print based on control commands received from the external device. A printing device thus connected to an external device may also detect the paper width based on sensor output and send information indicating the detected paper width to the external device at a specific timing. Based on this information, the external device then manages the paper width, and generates and sends control commands appropriate to the paper width to control printing by the printing device. However, the paper width indicated by the stored setting and the paper width managed by the external device may not match due to the time lag between the timing at which the information indicating the detected paper width is sent to the external device, and the timing when the paper guide is set. If the external device generates control commands, and the printing device executes the printing process, when these values do not match, printer mechanisms and printing results may again be adversely affected due to the mismatching values.

SUMMARY

At least one embodiment of the present invention suppresses adverse effects resulting from a mismatch between the paper width indicated by the stored setting and the width of the roll paper actually stored in the printing device.

A printing device according to at least one embodiment of the invention is able to store roll paper, and has a print unit (print mechanism) configured to print on roll paper; a storage compartment configured to hold the roll paper; a paper guide that limits the position of the roll paper in the storage compartment; a paper guide sensor configured to detect the installation position of the paper guide; a memory unit (memory) configured to store a setting indicating the paper width of the roll paper; and a control unit (controller) configured to cause the print unit to print based on the setting stored by the memory unit, and when the installation position of the paper guide detected by the paper guide sensor when triggered by a specific event is the installation position corresponding to roll paper of a first paper width that is not the paper width indicated by the setting, change the setting to the value indicating the first paper width.

In a printing device according to another aspect of at least one embodiment of the invention, the control unit does not change the setting regardless of the value of the setting when the paper guide is not installed.

Thus comprised, problems resulting from a mismatch between the value of the paper width indicated by the setting and the value of the paper width of the roll paper installed in the printing device can be suppressed.

In at least one embodiment of the invention, the specific event is at least one of a reset command and startup when the power turns on.

Compared with a configuration in which the state of the paper guide is continuously monitored, this aspect of the invention enables efficiently detecting the state of the paper guide while suppressing power consumption.

The printing device of at least one embodiment of the invention can further preferably communicate with an external device; has an opening to the storage compartment through which the roll paper can be loaded; a cover that opens and closes the opening to the storage compartment; a cover sensor configured to detect the cover; and a communication unit (communicator) configured to communicate with the external device. The control unit changes the setting to a value indicating the first paper width, and controls the communication unit to report the updated setting to the external device, when the installation position of the paper guide detected by the paper guide sensor when triggered by the cover sensor detecting movement of the cover from the open position to the closed position is the installation position corresponding to roll paper of the first paper width that is not the paper width indicated by the setting.

A printing device thus comprised can suppress problems resulting from the value of the paper width indicated by the setting and the value of the paper width managed by the external device not matching, and the value of the paper width indicated by the setting and the value of the paper width of the roll paper actually stored in the printing device not matching.

In a printing device according to another aspect of at least one embodiment of the invention, when the installation position of the paper guide is the installation position corresponding to roll paper of a first paper width that is not the paper width indicated by the setting, the control unit changes the setting to a value indicating the first paper width, executes a reset, and then reports the new setting to the external device.

Thus comprised, the setting can be efficiently reported to the external device using a process that reports the updated setting to the external device in the initialization process executed after resetting.

In a printing device according to another aspect of at least one embodiment of the invention, the control unit reports a reset to the external device, and reports the value of the setting stored by the memory unit to the external device in response to a query from the external device.

Thus comprised, the printing device can reliably report the setting when an external device recognizing the reset requests the setting.

In a printing device according to another aspect of at least one embodiment of the invention, the paper width indicated by the setting is greater than the first paper width.

Thus comprised, problems resulting from the value of the paper width indicated by the setting and the value of the paper width of the roll paper installed in the printing device not matching do not occur.

In a printing device according to another aspect of at least one embodiment of the invention, the control unit enables changing the setting stored by the memory unit, and sends the setting changed to the value indicating the first paper width to the external device, depending on an instruction of a control command sent by the external device or the setting of a software switch or a hardware switch.

Thus comprised, the user can intentionally change the setting. The external device can also know the first paper width that is detected and set.

In a printing device according to another aspect of at least one embodiment of the invention, the paper guide sensor detects the installation position of the paper guide when the paper guide is engaged with an engaging part of the storage compartment; and when the paper guide is disposed in the storage compartment but not engaged with the engaging part, and the cover moves from the open position to the closed position, the cover is pushed and the paper guide engages the engaging part.

Thus comprised, moving the cover to the closed position engages the paper guide with the storage compartment, and if the value of the paper width of the roll paper actually installed differs from the value of the setting when the cover is closed, eliminates the mismatch is eliminated.

A printing device according to another aspect of at least one embodiment of the invention preferably also has a conveyance unit (conveyer) that holds and conveys the roll paper between a thermal head and a platen roller; the control unit increasing the torque of a motor that drive the platen roller as the paper width indicated by the setting decreases.

Thus comprised, problems caused by increasing the torque of the motor that drives the platen roller as the paper width indicated by the setting decreases due to a mismatch between the value of the paper width indicated by the setting and the value of the paper width of the roll paper installed in the printing device can be suppressed.

Further preferably, when causing the print unit to print a string, the printing device changes the number of character columns on one line according to the paper width indicated by the setting.

Thus comprised, problems resulting from changing the number of character columns per line appropriately to the paper width indicated by the paper width setting due to a mismatch between the value of the paper width indicated by the setting and the value of the paper width of the roll paper stored in the printing device can be suppressed.

Another aspect of at least one embodiment of the invention is a control method of a printing device able to store roll paper and having a print unit configured to print on roll paper, a storage compartment configured to hold the roll paper, a paper guide that limits the position of the roll paper in the storage compartment, a paper guide sensor configured to detect the installation position of the paper guide, and a memory unit configured to store a setting indicating the paper width of the roll paper; the control method changes the setting to a value indicating a first paper width that is not the paper width indicated by the setting when the installation position of the paper guide detected by the paper guide sensor when triggered by a specific event is the installation position corresponding to roll paper of the first paper width.

Thus comprised, problems resulting from a mismatch between the value of the paper width indicated by the setting and the value of the paper width of the roll paper installed in the printing device can be suppressed.

The control method of a printing device that can communicate with an external device, has an opening to the storage compartment through which the roll paper can be loaded, a cover that opens and closes the opening to the storage compartment, and a cover sensor that detects the cover in another aspect of at least one embodiment of the invention changes the setting to a value indicating the first paper width, and reports the updated setting to the external device, when the installation position of the paper guide detected by the paper guide sensor when triggered by the cover sensor detecting movement of the cover from the open position to the closed position is the installation position corresponding to roll paper of the first paper width that is not the paper width indicated by the setting.

This aspect of the invention can suppress problems resulting from the value of the paper width indicated by the setting and the value of the paper width managed by the external device not matching, and the value of the paper width indicated by the setting and the value of the paper width of the roll paper actually stored in the printing device not matching.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
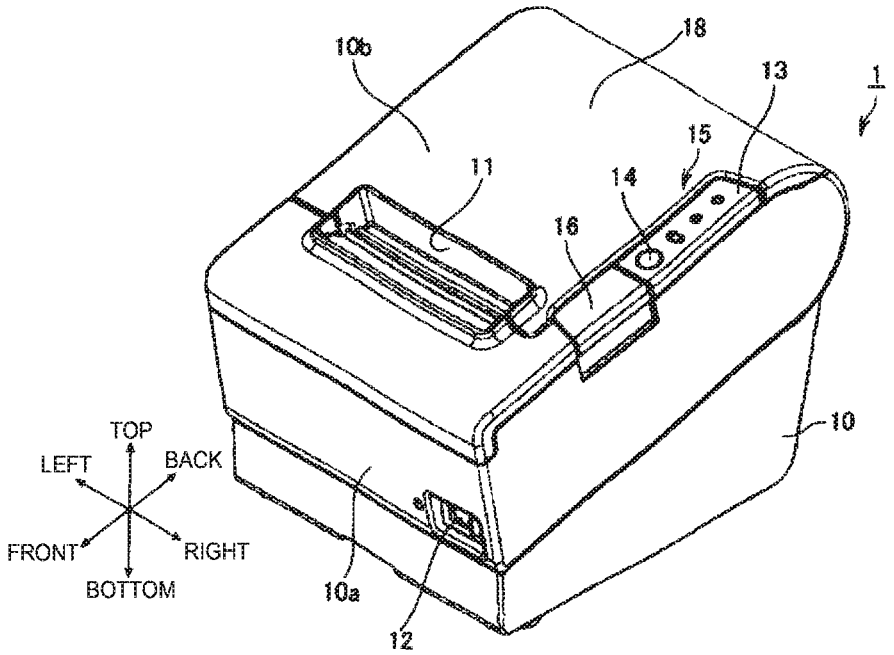
FIG. 1 is an oblique view of a printing device according to a preferred embodiment of the invention.

FIG. 1 is an oblique view of a printing device 1 according to an embodiment of the invention. Note that top and bottom, left and right, and front and back as used herein refer to the directions indicated by the arrows in FIG. 1.

The printing device 1 stores roll paper R (FIG. 3), and can produce tickets by printing images on the stored roll paper R and cutting the roll paper R after printing the images. The printing device 1 may be installed at a checkout counter in a supermarket, convenience store, or other retail store, or a restaurant or bar, and used to produce sales receipts, for example.

As shown in FIG. 1, the printing device 1 has a box-like cabinet 10.

A power switch 12 for turning the printing device 1 power on/off is disposed to the front 10*a* of the cabinet 10.

A paper exit 11 from which roll paper R stored in the paper compartment 20 (FIG. 2) of the printing device 1 is discharged is disposed in the front middle part of the top 10*b* of the cabinet 10.

A panel 13 is disposed behind the paper exit 11 on the right side of the top 10*b* of the cabinet 10. A pushbutton automatic feed switch 14 for commanding the conveying of the roll paper R is disposed on the panel 13. The roll paper R is automatically conveyed in the conveyance direction H1 (FIG. 3) while the automatic feed switch 14 is pressed. An LED display unit 15 is also disposed on the panel 13. The LED display unit 15 has multiple LEDs, and displays information related to the printing device 1, such as the operating mode of the printing device 1 and error status information, by turning the LEDs on/off in a specific pattern.

A lever 16 for opening the cover 18 is disposed in front of the panel 13. Depressing the lever 16 when the cover 18 is closed allows the cover 18 to move from closed to the open position.

The cover 18 is a member that opens and closes the opening 22 (FIG. 2) for loading and unloading roll paper R in the paper compartment 20 disposed inside the cabinet 10.

Figure 2:
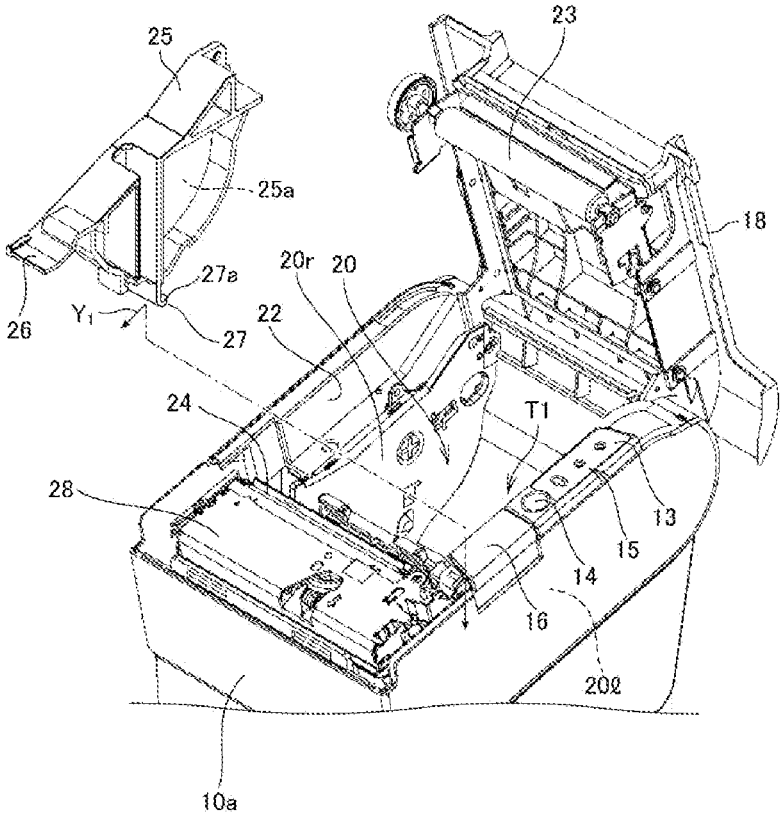
FIG. 2 is an oblique view of the printing device with the cover open.

FIG. 2 is an oblique view of the printing device 1 with the cover 18 open.

As shown in FIG. 2, when the cover 18 opens, the paper compartment 20 formed inside the cabinet 10 is exposed. The paper compartment 20 is an empty space for storing a roll of roll paper R. The roll paper R is can be loaded and removed through the opening 22 that is opened and closed by the cover 18.

As shown in FIG. 2, a platen roller 23 is disposed at the distal end of the cover 18. A thermal head 24 is disposed at a position below the paper exit 11 and opposite the platen roller 23 when the cover 18 is closed.

The platen roller 23 is a roller that conveys the roll paper R. The platen roller 23 turns in a specific direction with the roll paper R held between the platen roller 23 and the thermal head 24, and conveys the roll paper R in the conveyance direction H1 as it turns. Conveyance of the roll paper R by the platen roller 23 and thermal head 24 is described further below.

The thermal head 24 can be a thermal printhead disposed with multiple heat elements arrayed perpendicularly to the conveyance direction H1 of the roll paper R, and prints images on the roll paper R by the heat elements forming dots on the roll paper R, which is thermal paper.

As shown in FIG. 2, a cutter unit 28 is disposed at the front of the cabinet 10. The cutter unit 28 cuts the roll paper R by moving a movable knife relatively to the fixed knife.

A control board populated with a CPU, memory, and other control circuits, a power supply unit, and other mechanisms and parts are disposed at the front inside the cabinet 10.

The printing device 1 in this embodiment is compatible with roll paper R with a width of 58 mm (first paper width) (referred to below as 58 mm roll paper R), and roll paper R with a width of 80 mm (second paper width) (referred to below as 80 mm roll paper R), and is configured to print on roll paper R of these two widths. Both 58 mm roll paper R and 80 mm roll paper R can be stored as the roll paper R in the paper compartment 20 of the printing device 1.

When 80 mm roll paper R is stored in the paper compartment 20, the paper guide 25 (described below) is removed from the paper compartment 20. When the paper guide 25 is removed and 80 mm roll paper R is stored in the paper compartment 20, the widthwise (left-right) position of the 80 mm roll paper R in the paper compartment 20 is determined by the left side wall 20*r* on the left side of the paper compartment 20, and the right side wall 20*l* on the right side. As a result, the roll paper R is prevented from shifting left and right while printing images on the roll paper R, and a resulting drop in print quality is prevented.

When 58 mm roll paper R is loaded in the paper compartment 20, the paper guide 25 is installed on the right side T1 inside the paper compartment 20.

When the paper guide 25 is installed and 58 mm roll paper R is stored in the paper compartment 20, the widthwise position of the 58 mm roll paper R in the paper compartment 20 is determined by the leftside wall 20*r* and the side 25*a* of the paper guide 25 that is opposite the leftside wall 20*r* when the paper guide 25 is installed in the paper compartment 20. As a result, the roll paper R is prevented from shifting left and right while printing images on the roll paper R, and a resulting drop in print quality is prevented.

The paper guide 25 is positioned on the right side T1 of the paper compartment 20 by engaging an engaging part disposed in the paper compartment 20.

More specifically, as shown in FIG. 2, the paper guide 25 has a protrusion 26 projecting forward from the front, and an engaging claw 27 projecting down from the bottom.

A through-hole (not shown in the figure) through which the protrusion 26 can pass is disposed in the paper compartment 20 at a position corresponding to the location of the protrusion 26 when the paper guide 25 is set to the right side T1, an engaging channel (not shown in the figure) is disposed at a position corresponding to the location of the engaging claw 27 when the paper guide 25 is set to the right side T1. This through-hole and the engaging channel function as engaging parts in this example.

When the paper guide 25 is installed in the paper compartment 20, the protrusion 26 is first inserted to the through-hole in the paper compartment 20, and movement of the paper guide 25 left and right is thereby restricted. Next, with the protrusion 26 inserted to the through-hole in the paper compartment 20, the body of the paper guide 25 is rotated and pushed down pivoting on the protrusion 26. As the body of the paper guide 25 moves down, the claw part 27*a* of the engaging claw 27 contacts the edge of the engaging channel, causing the engaging claw 27 to elastically deform in the direction of arrow Y1 as the body of the paper guide 25 continues moving down, and the claw part 27*a* and the engaging channel engage elastically. By the claw part 27*a* engaging the engaging channel, the paper guide 25 is engaged with the engaging parts by the protrusion 26 and the engaging claw 27, vertical, longitudinal, and transverse movement of the paper guide 25 is restricted, and the paper guide 25 is positioned to the right side T1.

When the cover 18 is open, the paper guide 25 is disposed in the paper compartment 20 with the protrusion 26 inserted to the through-hole and the engaging claw 27 not engaged with the engaging channel (not engaged with the engaging part). This is the same position as when the user has intentionally disengaged the engaging claw 27 from the engaging channel, or the engaging claw 27 has been accidentally disengaged with the engaging channel as a result of impact to the printing device 1, such as the printing device 1 being dropped or another object striking the printing device 1.

When the paper guide 25 is thus disposed in the printing device 1 according to this embodiment and the cover 18 is moved from the open position to the closed position, the cover 18 and paper guide 25 contact as the cover 18 pivots, and the cover 18 pushes the paper guide 25 down and engages the engaging claw 27 with the engaging channel. In other words, even if the paper guide 25 is not fully engaged in position as described above, the paper guide 25 automatically engages the engaging part as a result of moving the cover 18 from the open position to the closed position.

Figure 3:
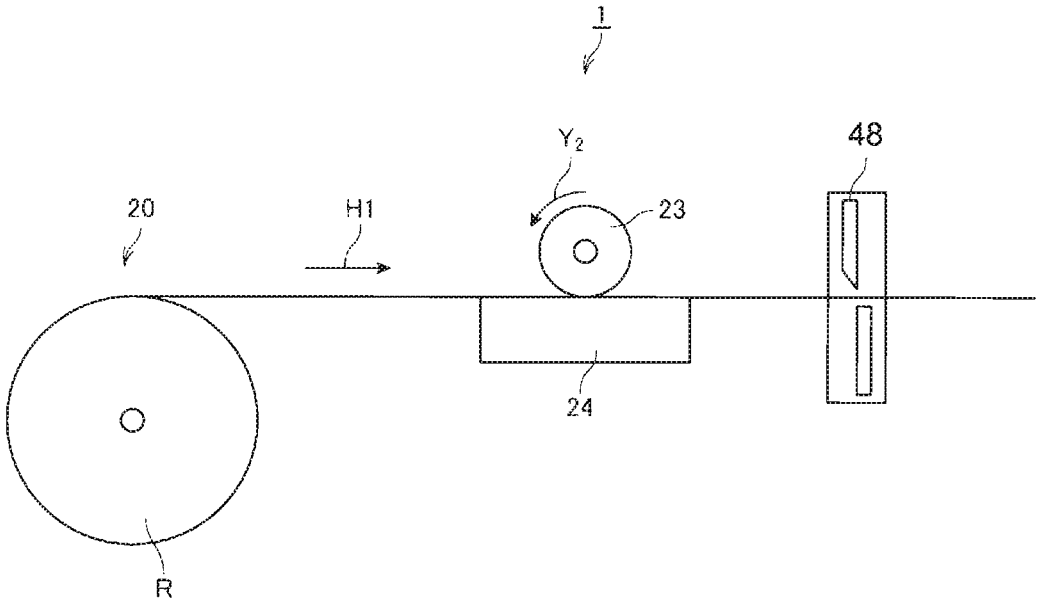
FIG. 3 illustrates the internal structure of the printing device.

FIG. 3 illustrates the internal configuration of the printing device 1, as described below.

Note that in the description below, the roll portion of the roll paper R installed in the paper compartment 20 is referred to as the paper roll, and the portion pulled and conveyed from the paper roll is the conveyed roll paper.

The conveyed roll paper is delivered and conveyed in the conveyance direction H1 from the paper roll stored in the paper compartment 20 of the printing device 1. As shown in FIG. 2, the platen roller 23 and thermal head 24 are disposed downstream in the conveyance direction H1 from the paper compartment 20. The platen roller 23 holds the conveyed roll paper with the thermal head 24 and conveys the conveyed roll paper in the conveyance direction H1 by turning in the direction of arrow Y2. The thermal head 24 prints images by forming dots with the heat elements on the conveyed roll paper being conveyed in the conveyance direction H1.

As shown in FIG. 3, the cutter unit 48 is disposed downstream in the conveyance direction H1 from the platen roller 23 and thermal head 24. The movable knife of the cutter unit 48 moves relative to the fixed knife, and the conveyed roll paper is cut by the knives crossing with the paper therebetween. The conveyed roll paper cut by the cutter unit 48 is then discharged from the paper exit 11 as a ticket.

Figure 4:
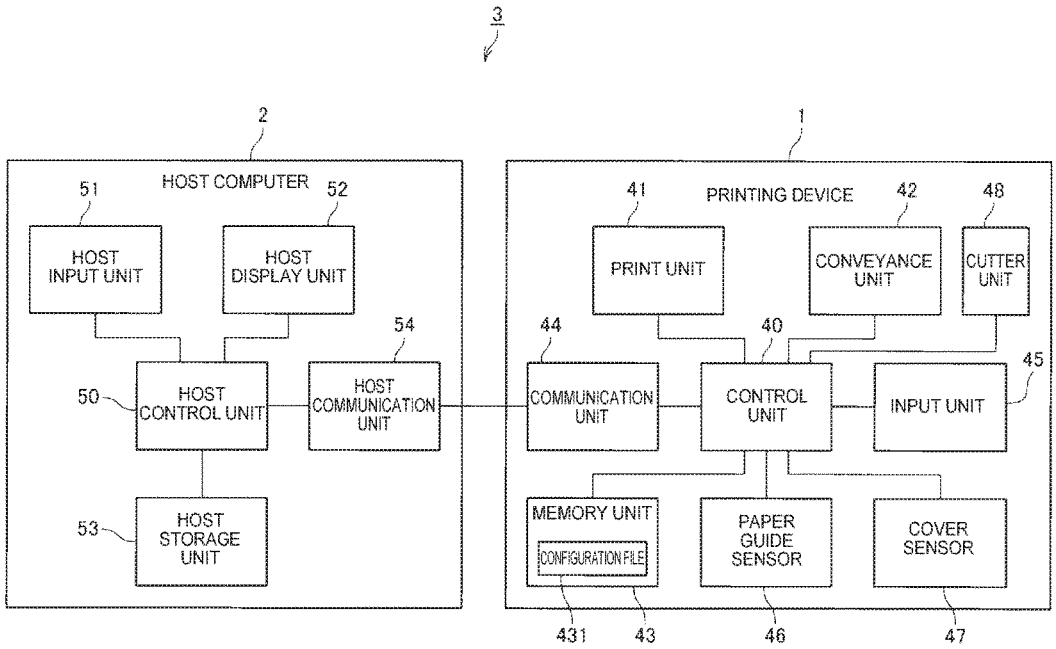
FIG. 4 is a block diagram of the functional configuration of the printing device and a host computer.

FIG. 4 is a block diagram illustrating the functional configuration of the printing device 1 and the host computer 2 (external device) that controls the printing device 1. A printing system 3 is embodied by the printing device 1 and a host computer 2.

As shown in FIG. 4, the printing device 1 has a control unit 40, control unit 40, print unit 41, conveyance unit 42, memory unit 43, communication unit 44, input unit 45, paper guide sensor 46, cover sensor 47, and cutter unit 48.

The control unit 40 comprises a CPU, ROM, RAM, and other peripheral circuits, and controls the printing device 1 by the CPU reading and running a control program, for example.

The print unit 41 has the thermal head 24 described above, a drive circuit that drives the thermal head 24, and other mechanisms related to printing on the roll paper R, and prints images on the roll paper R as controlled by the control unit 40.

The conveyance unit 42 includes the platen roller 23, a conveyance motor that drives the platen roller 23 rotationally, a motor driver that drives the conveyance motor, and other mechanisms related to conveying the roll paper R, and conveys the roll paper R as controlled by the control unit 40.

The memory unit 43 includes EEPROM or other non-volatile memory, and stores data. The memory unit 43 stores a configuration file 431. The configuration file 431 is described further below.

The communication unit 44 includes a communication module appropriate to a specific communication protocol such as USB or RS-232C, and mechanisms related to communicating with an external device (host computer 2), and communicates according to a specific communication protocol as controlled by the control unit 40. Note that communication with the external device may be by wire or wireless.

The input unit 45 is connected to operating switches including the power switch 12 and automatic feed switch 14 described above, detects operation of the switches, and outputs to the control unit 40. Based on input from the input unit 45, the control unit 40 executes a process appropriate to the operation of the operating switch.

The paper guide sensor 46 is a mechanical sensor that outputs different detection values according to the installation status of the paper guide 25 in the paper compartment 20. Note that installation of the paper guide 25 to the paper compartment 20 means the paper guide 25 is engaged with the engaging part of the paper compartment 20.

Describing the paper guide sensor 46 more specifically, the paper guide sensor 46 has a protrusion that is urged up inside the engaging channel that is engaged by the engaging claw 27 of the paper guide 25 described above. When the engaging claw 27 of the paper guide 25 is engaged with the engaging channel of the paper compartment 20, this protrusion is pushed down by the engaging claw 27; the protrusion activates a mechanical switch to the electrical "on" position, and a signal indicating that the paper guide 25 is installed is output as the detection value from the paper guide sensor 46 to the control unit 40. When the engaging claw 27 of the paper guide 25 is not engaged in the engaging channel of the paper compartment 20, the protrusion is released from being depressed, and a signal indicating that the paper guide 25 is not installed is output as the detection value from the paper guide sensor 46 to the control unit 40. If multiple different widths of paper may be used, an engaging channel may be formed at the appropriate position for each different paper width, and multiple paper guide sensors 46 may be provided to detect the engaging claw 27 of the paper guide 25 installed to the engaging channel corresponding to the width of the paper.

Based on the detection value input from the paper guide sensor 46, the control unit 40 detects if the paper guide 25 is installed to the paper compartment 20.

The cover sensor 47 is a sensor that detects a different value according to whether the cover 18 is open or closed. The cover sensor 47 outputs a signal indicating that the cover 18 is open as the detection value to the control unit 40 if the cover 18 is open, and outputs a signal indicating that the cover 18 is closed as the detection value to the control unit 40 if the cover 18 is closed.

Based on the detection value input from the cover sensor 47, the control unit 40 detects whether the cover 18 is open or closed.

The cutter unit 48 has a movable knife (not shown), a cutter motor that drives the movable knife of the cutter unit 48, a motor driver that drives the cutter motor, and other mechanisms related to cutting the roll paper R, and cuts the roll paper R as controlled by the control unit 40.

The host computer 2 is a computer that sends control commands to the printing device 1 and controls the printing device 1. When the printing device 1 is used for printing receipts at a checkout counter, for example, the host computer 2 generates and sends to the printing device 1 control commands that instruct the printing of a receipt printed with information related to the transaction based on the transaction made at the checkout counter, causing the printing device 1 to print a receipt.

As shown in FIG. 4, the host computer 2 has a host control unit 50, host input unit 51, host display unit 52, host memory unit 53, host communication unit 54.

The host control unit 50 comprises a CPU, ROM, RAM, and other peripheral circuits, and controls the host computer 2 by having the CPU read and running a control program, for example.

The host input unit 51 detects operation of operating switches disposed to the host computer 2 and input devices such as a keyboard connected to the host computer 2, and outputs to the control unit 40. The control unit 40 executes processes appropriate to the user operation based on input from the host input unit 51.

The host display unit 52 includes a display means such as an LCD panel or other display panel, and displays images on the display means as controlled by the host control unit 50.

The host memory unit 53 has nonvolatile memory and stores data.

The host communication unit 54 communicates with the printing device 1 according to a specific communication protocol as controlled by the host control unit 50.

The basic operation of the printing device 1 when printing images on the roll paper R is described next.

Figure 5:
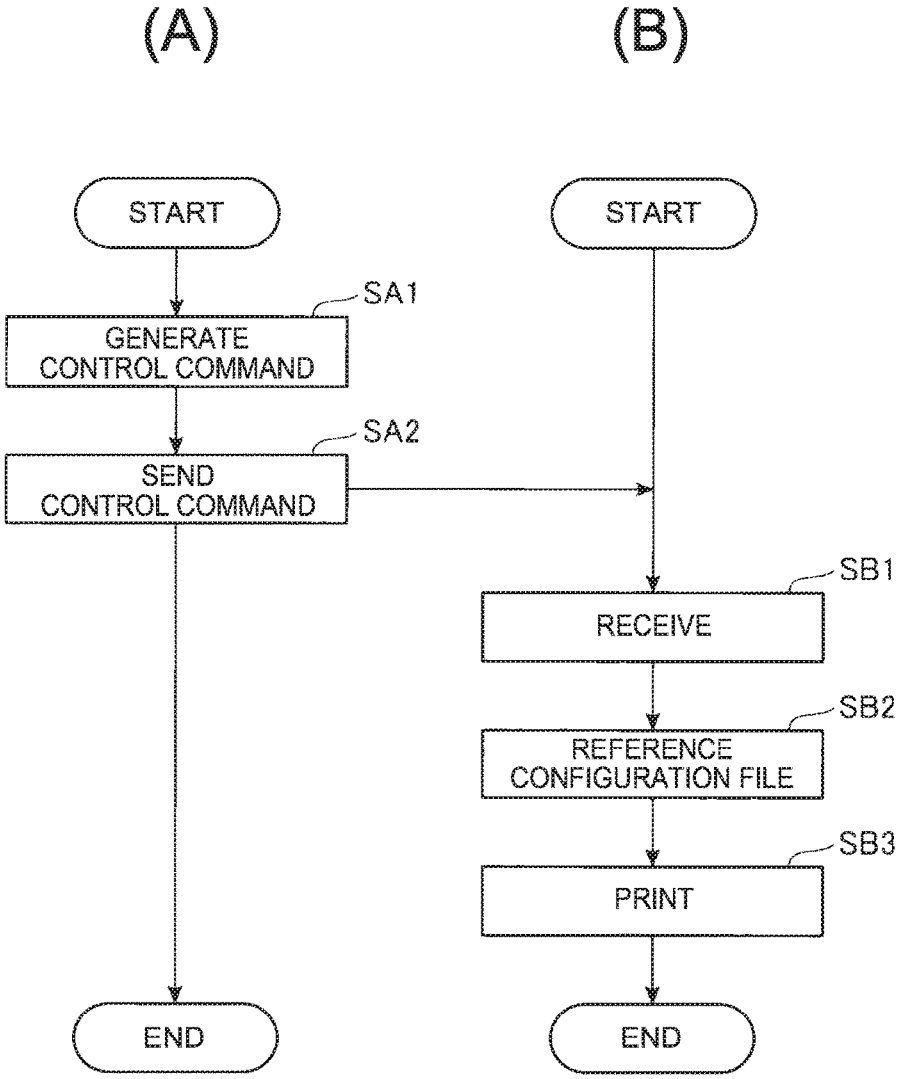
FIG. 5 is a flow chart of the operation of the host computer and printing device.

FIG. 5 is a flow chart of the operation of the host computer 2 and the printing device 1 when the printing device 1 prints an image on the roll paper R as controlled by the host computer 2. Column (A) of FIG. 5 shows the operation of the host computer 2, and column (B) of FIG. 5 shows the operation of the printing device 1.

As shown in FIG. 5, the host control unit 50 of the host computer 2 generates a control command instructing the printing of an image on the roll paper R (step SA1). A specific application and a printer driver are installed on the host computer 2. The specific application performs the function of outputting to the printer driver information related to the image to be printed by the printing device 1. The printer driver performs the function of generating control commands appropriate to the command language of the printing device 1 based on the information input from the specific application. In step SA1, the host control unit 50 generates the control commands by functions of the specific application and the printer driver.

Next, the host control unit 50 controls the host communication unit 54 to output the generated control commands to the printing device 1 (step SA2).

As shown in FIG. 5, the control unit 40 of the printing device 1 controls the communication unit 44 to receive the control commands sent by the host computer 2 (step SB1).

Next, the control unit 40 references the configuration file 431 stored by the memory unit 43 (step SB2).

The configuration file 431 is a file that stores settings related to printing (such as a setting related to the print speed, or a setting related to the print density), a setting related to communication, and other settings related to the printing device 1. The control unit 40 executes processes based on the settings recorded in the configuration file 431.

In this embodiment, a value (referred to below as the paper width setting) indicating the width of the roll paper R is recorded in the configuration file 431 as a setting related to printing.

Based on the control command received in step SB1, the control unit 40 controls the print unit 41 to print an image on the roll paper R based on the setting recorded in the configuration file 431.

More specifically, the control unit 40 controls the print unit 41 to execute the following process based on the paper width setting recorded in the configuration file 431.

More specifically, if the paper width setting is a value indicating 58 mm, the control unit 40 sets the torque of the conveyance motor that drives the platen roller 23 higher when conveying the roll paper R than when the paper width is 80 mm. The reason for this is described next. When the width of the roll paper R is 58 mm, the area between the platen roller 23 and thermal head 24 where the roll paper R passes is smaller than when the paper width if 80 mm, and the area of direct contact between the platen roller 23 and thermal head 24 is greater. As a result, the friction on the platen roller 23 is greater when driving the platen roller 23 when the width of the roll paper R is 58 mm than when 80 mm.

As a result, the control unit 40 of the printing device 1 according to this embodiment sets the torque of the conveyance motor that drives the platen roller 23 to convey roll paper R when the paper width setting is 58 mm higher than when the paper width setting is 80 mm. Problems such as described below can therefore happen when the paper width setting indicates a paper width of 80 mm but the width of the roll paper R actually installed in the printing device 1 is 58 mm. Specifically, the torque required to convey the roll paper R at a specific speed cannot be achieved and print quality may drop. The load on the conveyance motor may also increase and the conveyance motor may lose synchronism. The conveyance motor may also lose speed and the print speed may decrease.

When printing text strings, the control unit 40 also changes where a new line and carriage return are inserted in the string based on the paper width indicated by the paper width setting. This is described further below.

A font table is previously stored in the memory unit 43. A font table is a table storing sets of font data (bitmap data, scalable font data, for example) for each character.

To print a string, the control unit 40 references the font table and retrieves the font data for each character in the string. The control command sent by the host computer 2 expresses the string to be printed by the character code of each character in the string, and based on information relationally storing the character codes and font data, the control unit 40 acquires the font data for each character in the string.

Next, the control unit 40 renders the font data for the string to be printed on one line in a buffer. When rendering the font data in the buffer, the control unit 40 adjusts the number of font data that can be rendered in the buffer based on the paper width setting recorded in the configuration file 431. For simplicity and brevity, if 10 characters (columns) can be printed on 58 mm roll paper R, then 15 characters (columns) can be printed on 80 mm roll paper R. In this example, when the paper width setting in the configuration file 431 indicates 58 mm, the control unit 40 sets 10 as the number of font data (characters) that can be rendered on one line in the buffer, and when the paper width setting indicates 80 mm, the control unit 40 sets 15 as the number of font data (characters) that can be rendered on one line in the buffer. If the string is 20 characters long and the paper width setting indicates 58 mm, the control unit 40 renders font data for ten characters in the buffer, prints those ten characters on one line based on the font data rendered in the buffer, then renders font data for the remaining ten characters in the buffer, and prints those ten characters on one line based on the font data rendered in the buffer.

As a result of this process, a new line and line feed are inserted at an appropriate position in the string based on the paper width, and information being lost by printing the string without a return is prevented. In other words, when the print unit 41 is controlled to print a string, the number of character columns printed on one line changes according to the paper width indicated by the paper width setting.

As described above, the control unit 40 of the printing device 1 according to this embodiment changes where a carriage return is inserted in a string based on the paper width indicated by the paper width setting when printing text strings. The following problems can therefore occur if the actual paper width of the roll paper R installed in the printing device 1 and the value of the paper width indicated by the paper width setting in the configuration file 431 do not match.

More specifically, if the paper width indicated by the paper width setting is 80 mm, and the paper width of the roll paper R actually installed in the printing device 1 is 58 mm, text will be printed outside the paper width, required carriage returns will not be inserted where needed, and information may therefore be lost. If the paper width indicated by the paper width setting is 58 mm, and the paper width of the roll paper R actually installed in the printing device 1 is 80 mm, line feeds will be inserted leaving excess white space, unnecessary returns will be inserted, and print quality may drop.

The default paper width setting recorded in the configuration file 431 is 80 mm. The paper width setting is therefore a value indicating 80 mm unless the paper width setting is changed based on the value detected by the paper guide sensor 46, the paper width setting is changed based on an instruction in a control command, or the paper width setting is changed based on an instruction asserted by operating a switch, as described below.

As described above, the printing device 1 in this example can store 58 mm roll paper or 80 mm roll paper as the roll paper R.

The user of the printing device 1 is previously informed by the supplier (such as the company that manufactures and sells the printing device 1) that provides the printing device 1 that the print quality of the printing device 1 is not assured under the following circumstances. Specifically, this happens when the printing device 1 is used as a device for printing on 58 mm roll paper, and the printing device 1 is then used as a device for printing on 80 mm roll paper. The reason for this is described below.

Specifically, when the printing device 1 is used for printing on 58 mm roll paper, the platen roller 23 and thermal head 24 deteriorate according to usage over time. The platen roller 23 is a roller that is long enough in the direction transversely to the conveyance direction H1 to convey 80 mm roll paper. Therefore, when conveying 58 mm roll paper, part of the platen roller 23 contacts the 58 mm roll paper and part of the platen roller 23 does not contact the roll paper, and these parts wear (age) differently over time. The thermal head 24 is a printhead having an array of heat elements long enough in the direction transversely to the conveyance direction H1 to form dots across 80 mm roll paper. When forming dots on 58 mm roll paper, there are parts of the platen roller 23 that are used and parts that are not used, and these parts wear (age) differently over time.

Based on the foregoing, when the printing device 1 is used as a printer for printing on 58 mm roll paper, and the printing device 1 is then used as a printer for printing on 80 mm roll paper, due to aging differences in different parts of the platen roller 23 and thermal head 24, conveyance of the roll paper R may become skewed, formation of dots on the roll paper R may not be consistent, and print quality may drop.

As a result, the user is previously informed that print quality is not assured when the printing device 1 is used as a device for printing on 80 mm roll paper after using the printing device 1 as a device for printing on 58 mm roll paper.

It is therefore anticipated that the user will continue using the printer as a device for printing on 58 mm roll paper after using the printing device 1 to print on 58 mm roll paper.

As described above, the paper guide 25 is installed in the paper compartment 20 when 58 mm roll paper is loaded in the printing device 1. The paper guide 25 is also installed by engaging it with the engaging part of the paper compartment 20 instead of fastening it with screws, welding, adhesion, or other means that makes removal from the paper compartment 20 difficult. As a result, the parts count is reduced, the production cost is reduced, and installing the paper guide 25 is simple. On the other hand, because the paper guide 25 is not fastened with screws, welding, adhesion, or other means that makes removal from the paper compartment 20 difficult, the engaging claw 27 may be accidentally disengaged with the engaging channel when the printing device 1 is dropped, when the printing device 1 is struck with another object, or when the printing device 1 is subject to some other type of physical shock.

The printing device 1 according to this embodiment executes a process for handling such incidents. The operation of the printing device 1 is described in conjunction with what can happen when such events occur.

Figure 6:
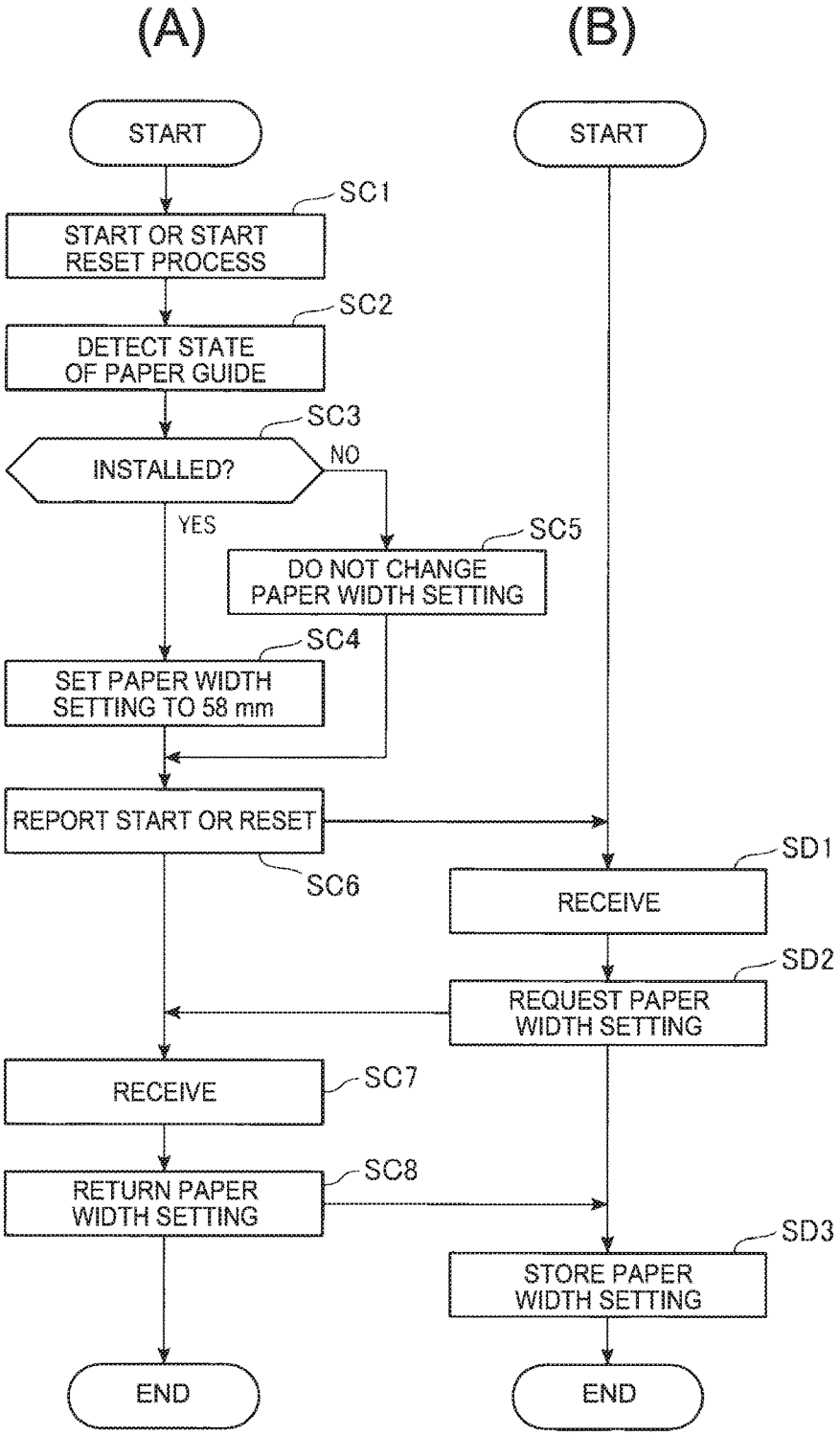
FIG. 6 is a flow chart of the operation of the host computer and printing device.

FIG. 6 is a flow chart of the initialization process run by the printing device 1 in conjunction with starting up and resetting, and the process executed by the host computer 2 in response to the initialization process of the printing device 1, when the system boots up and when it resets (reboots). Column (A) of FIG. 6 shows the operation of the printing device 1, and column (B) shows the operation of the host computer 2.

Note that the flow chart in FIG. 6 shows only part of the initialization process executed by the printing device 1.

As shown in FIG. 6, the control unit 40 of the printing device 1 starts the boot-up or reset process when triggered by the power turning on, a reset command, or other specific trigger (step SC1).

When the boot-up or reset process starts, the control unit 40 detects the status of the paper guide 25 (whether or not the paper guide 25 is installed) based on the detection value input from the paper guide sensor 46 (step SC2).

This embodiment of the invention thus detects the status of the paper guide 25 when triggered by the power turning on and the control unit 40 of the printing device 1 starting, or a reset (reboot) command asserted by a reset switch or reset signal when the power is already on. As a result, power consumption is reduced and detection is more efficient than when the status of the paper guide 25 is constantly monitored based on output from the paper guide sensor 46.

Next, the control unit 40 determines whether or not the paper guide 25 was installed based on the result from step SC2 (step SC3).

If the paper guide 25 was installed (step SC3: YES) and the paper width setting recorded in the configuration file 431 is a value indicating 80 mm, the control unit 40 changes the paper width setting to 58 mm; if the paper width setting is a value indicating 58 mm, the control unit 40 does not change the paper width setting and paper width setting remains the value indicating 58 mm (step SC4). Next, the control unit 40 goes to step SC6.

As a result of step SC4, if the paper guide 25 is installed in the paper compartment 20, that is, if 58 mm roll paper is loaded in the paper compartment 20 and the printing device 1 is used as a device for printing on 58 mm roll paper, the paper width of the roll paper R actually stored in the printing device 1 and the value of the paper width setting recorded in the configuration file 431 are not different, and the specific problems described above will not occur due to a mismatch between these values.

However, if the paper guide 25 is not installed (step SC3: NO), the control unit 40 does not change the paper width setting regardless of the value of the paper width setting recorded in the configuration file 431 (step SC5). This state is therefore maintained when the paper width setting is a value indicating 58 mm. The control unit 40 then goes to step SC6.

The reason for the process of step SC5 is described below.

Specifically, the default paper width setting is 80 mm. Therefore, the paper width setting being a value indicating 58 mm means that the process of step SC4 executed previously and the paper width setting was changed based on output from the paper guide sensor 46, or the paper width setting was changed based on an instruction from a control command or operation of a switch as described below. Because print quality is not assured when the printing device 1 is used to print on 58 mm roll paper and is then changed to print on 80 mm roll paper as described above, if the printing device 1 is used as a printer for printing on 58 mm roll paper, it continues being used as a printer for printing on 58 mm roll paper.

Based on the foregoing, if the paper guide 25 is not installed and the paper width setting indicates a paper width of 58 mm, the engaging claw 27 may have been accidentally disengaged from the engaging channel because the printing device 1 was dropped, the printing device 1 was struck with another object, or the printing device 1 was subject to some other type of physical shock, and the printing device 1 then started or reset with the cover 18 open.

In this event, because the printing device 1 is used as a device for printing to 58 mm roll paper, the paper guide 25 is installed to the paper compartment 20 by the user, or the paper guide 25 is installed to the paper compartment 20 in conjunction with the cover 18 moving from the open to the closed position, before the printing process starts.

For this reason, the control unit 40 does not change the paper width setting in step SC5 regardless of the value of the paper width setting recorded in the configuration file 431 even if the paper guide 25 is not installed. In other words, if the paper guide 25 is not installed, the control unit 40 does not change the paper width setting even if the paper width setting is a value indicating 58 mm. As a result, differences between the paper width of the roll paper R actually installed in the printing device 1 and the value of the paper width setting recorded in the configuration file 431 can be suppressed, and the specific problems described above resulting from these values not matching can be suppressed.

In step SC6, the control unit 40 controls the communication unit 44 to send data reporting starting or resetting to the host computer 2.

As shown in FIG. 6, the host control unit 50 of the host computer 2 controls the host communication unit 54 to receive the data sent by the printing device 1 in step SC6 (step SD1).

Next, based on the data received in step SD1, the host control unit 50 knows that the printing device 1 started or reset, and controls the host communication unit 54 to send to the printing device 1 data requesting a response indicating the paper width setting (the setting after being changed) recorded in the configuration file 431 of the printing device 1 (step SD2).

As shown in FIG. 6, the control unit 40 of the printing device 1 controls the communication unit 44 to receive the data sent in step SD2 by the host computer 2 (step SC7).

Next, the control unit 40 references the configuration file 431 and acquires the paper width setting based on the data received in step SC7, and controls the communication unit 44 to send data including the acquired paper width setting to the host computer 2 (step SC8).

As shown in FIG. 6, the host control unit 50 of the host computer 2 then controls the host communication unit 54 to receive the data the printing device 1 sent in step SC8, and stores the paper width setting contained in the received data in a specific storage area (step SD3).

As a result of the foregoing process, the value of the paper width setting recorded in the configuration file 431 of the printing device 1 and the value of the paper width setting stored in the specific storage area of the host computer 2 match.

Thereafter when generating control commands, the host control unit 50 generates control commands appropriate to the paper width indicated by the paper width setting stored in the specific storage area. For example, if image data is contained in the control command sent to the printing device 1, the host control unit 50 may process the image data appropriately to the paper width as required.

The process executed by the printing device 1 when the power turns on is described next.

Figure 7:
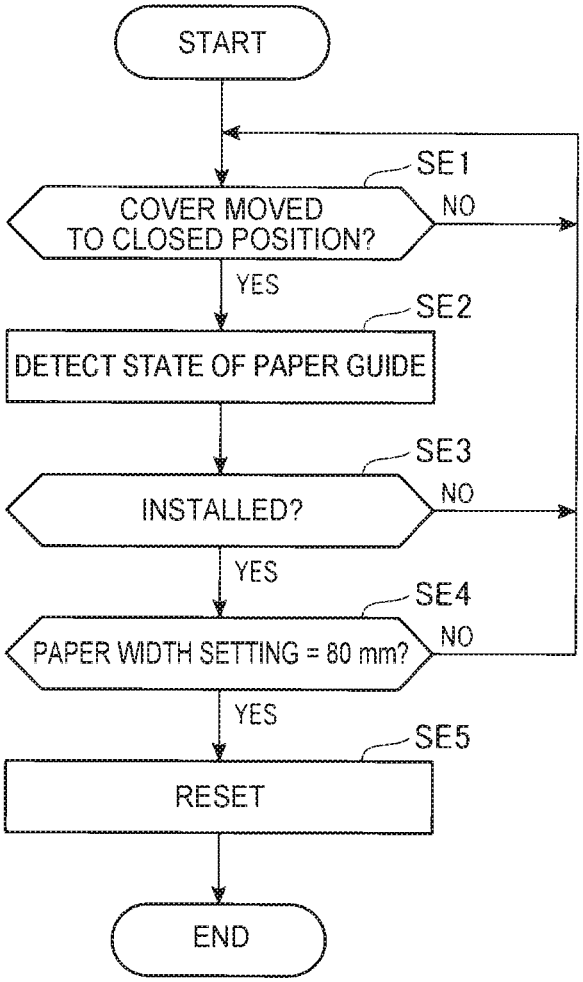
FIG. 7 is a flow chart of the operation of the printing device.

FIG. 7 is a flow chart of the operation of the printing device 1 when the power turns on.

As shown in FIG. 7, the control unit 40 of the printing device 1 monitors whether the cover 18 is open or closed based on the detection value input from the cover sensor 47 (step SE1).

If movement of the cover 18 from the open position to the closed position was detected (step SE1: YES), the control unit 40 detects the status of the paper guide 25 based on the detection value input from the paper guide sensor 46 (step SE2).

Next, the control unit 40 determines whether the paper guide 25 was installed based on the result of step SE2 (step SE3).

If the paper guide 25 was not installed (step SE3: NO), the control unit 40 returns to step SE1. If the cover 18 is closed and the paper guide 25 is not installed, engagement of the paper guide 25 was not accidentally released. In this case this is because the paper guide 25 is automatically engaged with the engaging part in conjunction with the cover 18 moving from the open position to the closed position as described above. Therefore, if the cover 18 is closed and the paper guide 25 is not installed, the user has not intentionally installed the paper guide 25, and the user knows that the paper guide 25 is not installed. That the printing device 1 has been continuously used as a device for printing on 80 mm roll paper, and the paper width setting recorded in the configuration file 431 is a value indicating 80 mm, is therefore assumed if the paper guide 25 was not installed when the cover 18 closed.

As a result, control goes to step SE1 without resetting if the paper guide 25 is determined in step SE3 to not be installed.

If the paper guide 25 is determined in step SE3 to be installed (step SE3: YES), the control unit 40 references the configuration file 431 to determine whether the paper width setting recorded in the configuration file 431 is a value indicating 80 mm (step SE4).

If the paper width setting recorded in the configuration file 431 is not a value indicating 80 mm (step SE4: NO), in other words, if paper width setting recorded in the configuration file 431 is a value indicating 58 mm, the control unit 40 returns to step SE1. This is because the value of the paper width of the roll paper R actually installed in the paper compartment 20, and the value of the paper width setting recorded in the configuration file 431, match.

However, if the paper width setting recorded in the configuration file 431 is not a value indicating 80 mm (step SE4: YES), the control unit 40 initiates a reset command (step SE5). If a reset is initiated in step SE5, the initialization process shown in FIG. 6 is executed. In this iteration of the initialization process, the control unit 40 changes the paper width setting to 58 mm in step SC4. As a result, the value of the paper width of the roll paper R actually installed in the paper compartment 20, and the value of the paper width setting recorded in the configuration file 431, match. In addition, the control unit 40 reports the updated paper width setting to the host computer 2 in step SC8. As a result, the value of the paper width setting recorded in the configuration file 431 of the printing device 1, and the value of the paper width setting stored in the specific storage area of the host computer 2, match.

As described, if the control unit 40 determines based on the detection value from the paper guide sensor 46 that the paper guide 25 is installed, and the value of the paper width setting recorded in the configuration file 431 is a value indicating 80 mm, the control unit 40 executes a reset, rewrites the paper width setting in the initialization process invoked by the reset, and reports the paper width setting to the host computer 2.

If the paper guide 25 is installed and the value of the paper width setting recorded in the configuration file 431 is a value indicating 80 mm, to resolve the mismatch between the paper width of the roll paper R actually stored in the paper compartment 20 and the value of the paper width setting, the paper width setting must be rewritten and the paper width setting reported to the host computer 2. However, if the paper guide 25 is not installed when the cover 18 closes, or if the paper guide 25 is installed and the value of the paper width setting indicates 58 mm, the value of the paper width of the roll paper R actually stored in the paper compartment 20 and the value of the value of the paper width setting match, and there is no need to rewrite the paper width setting and report the paper width setting to the host computer 2.

Furthermore, because the control unit 40 executes a reset when the paper guide 25 is determined based on the detection value of the paper guide sensor 46 to be installed and the value of the paper width setting recorded in the configuration file 431 is determined to be a value indicating 80 mm, unnecessary resets can be prevented, downtime in which the printing device 1 cannot be used because a reset is in progress can be suppressed, and user convenience and satisfaction can be improved.

The paper width setting recorded in the configuration file 431 can be changed by the user, as described below.

For example, the user may change the value of the paper width setting recorded in the configuration file 431 by an instruction initiated by operating a memory switch (software switch). The software switch may be input to a specific user interface provided by a terminal on which a software tool for printing device 1 maintenance is installed. Further alternatively, the paper width setting could be set by pressing a paper feed switch using a specific combination of long and short pushes.

The user may also change the value of the paper width setting recorded in the configuration file 431 by operating (setting) a dedicated DIP switch (hardware switch) on a control board.

Yet further, the user may change the value of the paper width setting recorded in the configuration file 431 by sending a specific control command to the printing device 1 from an external device connected to the printing device 1. The external device may be the host computer 2, or a device other than the host computer 2 such as a terminal on which a software tool for printing device 1 maintenance is installed.

The user can thus intentionally change the value of the paper width setting recorded in the configuration file 431. As a result, when the printing device 1 has been used as a device for printing on 58 mm roll paper, and the printing device 1 is then repurposed as a printer for printing to 80 mm roll paper, the user can change the value of the paper width setting recorded in the configuration file 431 so there is not a mismatch between the value of the paper width of the roll paper R actually stored in the printing device 1 and the value of the paper width setting recorded in the configuration file 431.

As described above, the printing device 1 according to this embodiment has a print unit 41 for printing on roll paper R; a paper compartment 20 that stores roll paper R; and a paper guide 25 that is installed or not depending on the paper width of the roll paper R stored in the paper compartment 20, and restricts the position of the roll paper R in the paper compartment 20.

The printing device 1 also has a paper guide sensor 46 that outputs a different detection value depending on the status of the paper guide 25; a memory unit 43 that stores a paper width setting (configuration setting) indicating the paper width of the roll paper R; and a control unit 40 that causes the print unit 41 to print based on the paper width setting stored by the memory unit 43. The control unit 40 detects the state of the paper guide 25 based on the detection value of the paper guide sensor 46 when triggered by a start or reset (restart) operation. When the paper guide 25 is installed in the paper compartment 20 (a state corresponding to roll paper R of a first paper width), and the paper width setting is a value indicating 80 mm (second paper width) (a value indicating a paper width other than the first paper width), the control unit 40 changes the paper width setting to a value indicating 58 mm. If the paper guide 25 is not installed in the paper compartment 20 (a state corresponding to roll paper R of a paper width other than the first paper width), the control unit 40 does not change the setting regardless of the value of the paper width setting.

If the paper width setting is once changed to 58 mm and the printing device 1 then starts or resets (restarts), the paper width setting is not changed even if the status of the paper guide 25 is detected based on the detection value of the paper guide sensor 46, and the paper guide 25 is either not installed in the paper compartment 20 or is installed appropriately to another paper width (a state corresponding to roll paper R of a paper width other than the specific paper width).

This configuration prevents a mismatch between the value of the paper width of the roll paper R actually stored in the printing device 1 and the value of the paper width setting when the paper guide 25 is installed. In addition, if the paper guide 25 is accidentally released from engagement with the engaging part, the paper width setting being changed to a value indicating 80 mm before printing starts even though the paper guide 25 is installed, and a mismatch occurring between the value of the paper width of the roll paper R actually stored in the paper compartment 20 and the value of the paper width setting, can be prevented. As a result, problems resulting from a mismatch between the value of the paper width indicated by the paper width setting, and the value of the paper width of the roll paper R stored in the printing device 1, can be suppressed.

The paper width setting stored by the memory unit 43 in this embodiment of the invention can also be changed by an instruction of a control command sent by an external device, or an instruction issued by operating a software switch or hardware switch.

Thus comprised, when the host computer 2 is used as a device for printing to 58 mm roll paper, and for some reason the printing device 1 is then used as a device for printing to 80 mm roll paper, the user can change the paper width setting recorded in the configuration file 431 and prevent a mismatch between the value of the paper width of the roll paper R actually stored in the printing device 1 and the value of the paper width setting recorded in the configuration file 431.

As described above, the printing device 1 according to this embodiment has a cover sensor 47 for detecting a detection value that differs according to whether the cover 18 is open or closed, and a communication unit 44 that communicates with a host computer 2 (external device). When movement of the cover 18 from the open position to the closed position is detected based on the detection value of the cover sensor 47, the control unit 40 detects the status of the paper guide 25 based on the detection value from the paper guide sensor 46. As a result, when the paper guide 25 is installed (a state corresponding to roll paper R of a first paper width) and the paper width setting is a value indicating 80 mm (a value indicating a paper width different from the first paper width), the control unit 40 runs a process changing the paper width setting to a value indicating 58 mm, and a process reporting the new paper width setting to the host computer 2.

Thus comprised, a mismatch between the value of the paper width of the roll paper R actually stored in the paper compartment 20 and the value of the paper width setting when the paper guide 25 is installed can be prevented. Furthermore, because the new paper width setting is reported to the host computer 2, a mismatch between the value of the paper width setting and the value of the paper width setting managed by the host computer 2 can be prevented. In other words, problems resulting from a mismatch between the value of the paper width indicated by the paper width setting, and the value of the paper width managed by the host computer 2, and a mismatch between the value of the paper width indicated by the paper width setting and the value of the paper width of the roll paper R actually stored in the printing device 1, can be suppressed.

When the paper guide 25 is installed and the paper width setting is a value indicating 80 mm in this embodiment of the invention, the control unit 40 executes a reset, and in the initialization process accompanying the reset executes a process of changing the paper width setting to a value indicating 58 mm, and a process of reporting the new paper width setting to the host computer 2.

Thus comprised, the paper width setting can be efficiently reported to the host computer 2 by using the process of reporting the paper width setting to the host computer 2 in the initialization process accompanying the reset.

The preferred embodiment of the invention described above can be varied in many ways without departing from the scope of the accompanying claims as described below.

Figure 8:
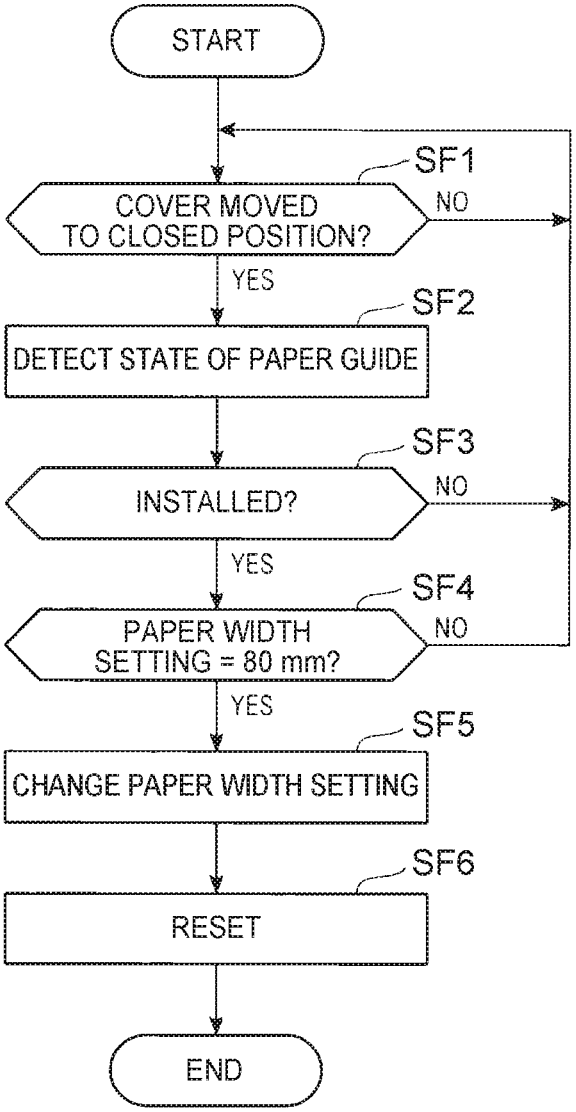
FIG. 8 is a flow chart of the operation of the printing device.

FIG. 8 is a flow chart of the operation of the printing device 1 when the power turns on.

As shown in FIG. 8, the control unit 40 of the printing device 1 monitors whether or not the cover 18 moves from open to closed based on the detection value input from the cover sensor 47 (step SF1).

If the cover 18 closed from the open position (step SF1: YES), the control unit 40 detects the state of the paper guide 25 (whether or not the paper guide 25 is installed) based on the detection value input from the paper guide sensor 46 (step SF2).

Next, the control unit 40 determines whether or not the paper guide 25 is installed based on the detection result from step SF2 (step SF3).

If the paper guide 25 is not installed (step SF3: NO), the control unit 40 returns to step SF1. If the cover 18 is closed and the paper guide 25 is determined to be not installed, engagement of the paper guide 25 has not been accidentally released. This is because, as described above, the paper guide 25 is automatically engaged with the engaging part in conjunction with the cover 18 moving from the open position to the closed position. Therefore, if the cover 18 is closed and the paper guide 25 is not detected as being installed, the user did not intentionally install the paper guide 25 and the user knows that the paper guide 25 is not installed. Therefore, if the paper guide 25 is not installed and the cover 18 is closed, it may be assumed that the printing device 1 is continuously used as a device for printing 80 mm roll paper and the paper width setting recorded in the configuration file 431 is a value indicating 80 mm.

As a result, when the paper guide 25 is determined in step SF3 to not be installed, a reset is not executed and control goes to step SF1.

When the paper guide 25 is determined in step SF3 to be installed (step SF3: YES), the control unit 40 references the configuration file 431 to determine if the paper width setting recorded in the configuration file 431 is a value indicating 80 mm (step SF4).

If the paper width setting recorded in the configuration file 431 is not a value indicating 80 mm (step SF4: NO), in other words, if paper width setting recorded in the configuration file 431 is a value indicating 58 mm, the control unit 40 returns to step SF1. This is because the value of the paper width of the roll paper R actually installed in the paper compartment 20, and the value of the paper width setting recorded in the configuration file 431, match.

However, if the paper width setting recorded in the configuration file 431 is a value indicating 80 mm (step SF4: YES), the control unit 40 changes the value of the paper width setting recorded in the configuration file 431 to a value indicating 58 mm (step SF5). As a result of step SF5, when the paper guide 25 is installed in the paper compartment 20, that is, when 58 mm roll paper is installed in the paper compartment 20 and the printing device 1 is used as a device for printing on 58 mm roll paper, the value of the paper width of the roll paper R actually stored in the printing device 1 and the value of the paper width setting recorded in the configuration file 431 will not differ, and the specific problems resulting from a mismatch between these values will not occur.

Next, the control unit 40 executes a software reset of the printing device 1 (step SF6). As will be understood below, when a reset is executed in step SF6, the updated (new) paper width setting is reported to the host computer 2 in the initialization process accompanying the reset. As a result, the value of the paper width setting recorded in the configuration file 431 of the printing device 1, and the value of the paper width setting recorded in the specific storage area of the host computer 2 (the paper width setting of the printing device 1 managed by the host computer 2), will match.

When the paper guide 25 is determined to be installed based on the detection value from the paper guide sensor 46, and the value of the paper width setting recorded in the configuration file 431 is a value indicating 80 mm, the control unit 40 in this example rewrites the paper width setting, then executes a reset, and reports the paper width setting to the host computer 2.

When the paper guide 25 is installed and the value of the paper width setting recorded in the configuration file 431 is a value indicating 80 mm, the value of the paper width setting must be rewritten, a reset executed, and the new paper width setting reported to the host computer 2 in order to resolve a mismatch between the value of the paper width of the roll paper R actually stored in the paper compartment 20 and the value of the paper width setting. Because the value of the paper width of the roll paper R actually stored in the paper compartment 20 and the value of the paper width setting match when the cover 18 is closed and the paper guide 25 is not installed, and when the paper guide 25 is installed and the value of the paper width setting is a value indicating 58 mm, there is no need to rewrite the paper width setting, reset, and report the paper width setting to the host computer 2 in conjunction with the reset.

Furthermore, because the control unit 40 executes a reset when the paper guide 25 is determined to be installed based on the detection value of the paper guide sensor 46, and the value of the paper width setting recorded in the configuration file 431 is a value indicating 80 mm, unnecessary resets can be prevented, downtime in which the printing device 1 cannot be used because a reset is in progress can be suppressed, and user convenience and satisfaction can be improved.

Figure 9:
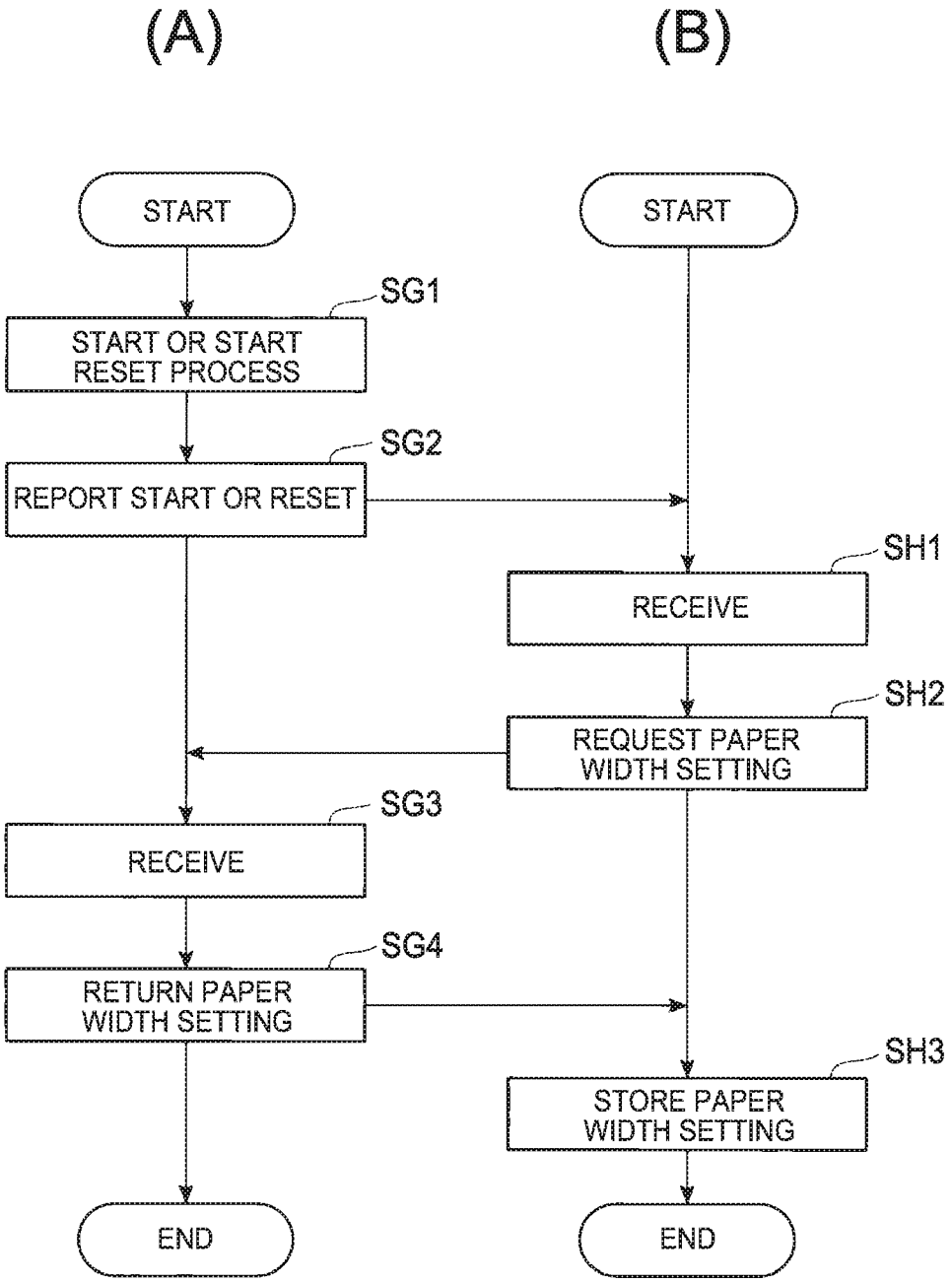
FIG. 9 is a flow chart of the operation of the host computer and printing device.

FIG. 9 is a flow chart of another example of the initialization process run by the printing device 1 in conjunction with starting up and resetting, and the process executed by the host computer 2 in response to the initialization process of the printing device 1, when the system boots up and when it resets (restarts). Column (A) of FIG. 9 shows the operation of the printing device 1, and column (B) shows the operation of the host computer 2.

Note that the flow chart in FIG. 9 shows only part of the initialization process executed by the printing device 1.

As shown in FIG. 9, the control unit 40 of the printing device 1 starts the boot or reset process when triggered by a startup command from the power turning on, operation of a reset switch when the power is already on, input of a reset signal, a software reset (restart) of the printing device 1 by the control unit 40, or other specific trigger (step SG1).

Next, the control unit 40 controls the communication unit 44 to send data reporting that a reset was executed to the host computer 2 (step SG2). The process of step SG2 may be initiated by sending a reset signal over a cable, for example.

As shown in FIG. 9, the host control unit 50 of the host computer 2 controls the host communication unit 54 to receive the data the printing device 1 sent in step SG6 (step SH1). Because a printing device 1 is typically reset because of some change of state or settings, the host computer 2 receives the reset report and attempts to acquire the change in the state or setting of the printing device 1.

Next, the host control unit 50 knows that the printing device 1 executed a reset based on the data received in step SH1, and controls the host communication unit 54 to send to the printing device 1 data requesting the paper width setting recorded in the configuration file 431 of the printing device 1 (the new (updated) setting) in response (step SH2).

As shown in FIG. 9, the control unit 40 of the printing device 1 controls the communication unit 44 to receive the data sent in step SH2 by the host computer 2 (step SG3).

Next, the control unit 40 references the configuration file 431 and acquires the paper width setting based on the data received in step SG3, and controls the communication unit 44 to send data including the acquired paper width setting to the host computer 2 (step SG4).

As shown in FIG. 9, the host control unit 50 of the host computer 2 controls the host communication unit 54 to receive the data the printing device 1 sent in step SG4, and stores the paper width setting contained in the received data to a specific storage area (step SH3).

As a result of this process, the value of the paper width setting recorded in the configuration file 431 in the printing device 1, and the value of the paper width setting stored in a specific storage area of host computer 2, match.

Thereafter when generating control commands, the host control unit 50 generates control commands appropriate to the paper width indicated by the paper width setting stored in the specific storage area. For example, if image data is contained in the control command sent to the printing device 1, the host control unit 50 may process the image data appropriately to the paper width as required.

As described above, the paper width setting recorded in the configuration file 431 can be changed by the user as described below. For example, the user may intentionally change the value of the paper width setting recorded in the configuration file 431 by an instruction asserted by operating a memory switch (software switch), by operating (setting) a DIP switch (hardware switch), or by sending a specific control command to the printing device 1 from an external device.

The printing device 1 according to the foregoing embodiment and examples has a thermal head 24, and a conveyance unit 42 that holds and conveys the roll paper R with the platen roller 23. The control unit 40 increases the torque of the motor that drives the platen roller 23 as the paper width indicated by the paper width setting decreases.

Thus comprised, problems resulting from increasing the torque of the motor that drives the platen roller 23 as the paper width indicated by the paper width setting decreases due to a mismatch between the value of the paper width indicated by the paper width setting and the value of the paper width of the roll paper R actually stored in the printing device 1 can be suppressed.

In the foregoing embodiment and examples, the control unit 40 changes where new lines are inserted according to the paper width indicated by the paper width setting when controlling the print unit 41 to print text strings.

Thus comprised, problems resulting from changing the number of character columns per line appropriately to the paper width indicated by the paper width setting due to a mismatch between the value of the paper width indicated by the paper width setting and the value of the paper width of the roll paper R stored in the printing device 1 can be suppressed.

In the foregoing embodiment and examples, the control unit 40 reports that a reset was executed to the host computer 2 during the initialization process, and reports the paper width setting to the host computer 2 in response to a query from the host computer 2 in response to the reset report.

Thus comprised, the printing device 1 can reliably report the paper width setting to the host computer 2.

In the foregoing embodiment and examples, the detection value output by the paper guide sensor 46 changes when the paper guide 25 is engaged with the engaging part of the paper compartment 20. If the paper guide 25 is installed in the paper compartment 20 without engaging the engaging part, and the cover 18 then moves from the open position to the closed position, the paper guide 25 automatically engages the engaging part in conjunction with movement of the cover 18.

Thus comprised, the paper guide 25 can be engaged with the paper compartment 20 by moving the cover 18 to the closed position, and if there is a mismatch between the value of the paper width of the roll paper R that is actually stored and the value of the paper width setting when the cover 18 is closed, closing the cover 18 resolves the mismatch.

The invention is described above with reference to a preferred embodiment thereof, but the invention is not limited thereto and can be modified and adapted in many ways without departing from the scope of the accompanying claims.

For example, different widths of roll paper R are positioned in the foregoing embodiment and examples by installing or not installing the paper guide 25. However, a configuration in which the position of the paper guide 25 can be changed to position roll paper R of different widths is also conceivable.

After two widths of roll paper R, 58 mm and 80 mm, can be used in the printing device 1 described in the foregoing embodiment and examples, the paper widths that can be used in the printing device 1 are not limited to two, and the paper widths are not limited to 58 mm and 80 mm.

The function blocks described above with reference to the figures can be embodied as desired by the cooperation of hardware and software. Hardware not described herein also can be used.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A printing device, comprising:

a print mechanism configured to print on roll paper having a width;

a storage compartment configured to hold the roll paper;

a paper guide that limits the position of the roll paper in the storage compartment;

a paper guide sensor configured to detect an installation position of the paper guide;

a memory configured to store a setting indicating a paper width of the roll paper based on the installation position of the paper guide; and a controller configured to: cause the print mechanism to print based on the setting stored by the memory even if the setting indicating the paper width of the roll paper is different from the paper width of the roll paper based on the installation position of the paper guide detected by the paper guide sensor of the paper guide; and when the installation position of the paper guide detected by the paper guide sensor when triggered by a specific event is the installation position corresponding to roll paper of a first paper width that is not the setting stored by the memory, change the setting to a value indicating the first paper width, wherein the controller does not change the setting regardless of the value of the setting when the paper guide is not installed.

2. The printing device described in claim 1, wherein the specific event is at least one of a reset command and startup when power turns on.

3. The printing device described in claim 1, further including:

a cover that opens and closes the opening to the storage compartment;

a cover sensor configured to detect the cover; and a communicator configured to communicate with an external device, wherein the printing device is configured to communicate with the external device;

the storage compartment has an opening through which the roll paper can be loaded, and the controller changes the setting to an updated setting indicating the first paper width, and controls the communicator to report the updated setting to the external device when the installation position of the paper guide detected by the paper guide sensor when triggered by the cover sensor detecting movement of the cover from the open position to the closed position is the installation position corresponding to roll paper of the first paper width that is not the paper width indicated by the setting.

4. The printing device described in claim 3, wherein when the installation position of the paper guide is the installation position corresponding to roll paper of a first paper width that is not the paper width indicated by the setting, the controller changes the setting to a new setting indicating the first paper width, executes a reset, and then reports the new setting to the external device.

5. The printing device described in claim 4, wherein the controller reports a reset to the external device, and reports the value of the setting stored by the memory to the external device in response to a query from the external device.

6. The printing device described in claim 1, wherein the paper width indicated by the setting is greater than the first paper width.

7. The printing device described in claim 1, wherein the controller enables changing the setting stored by the memory, and sends the setting changed to the value indicating the first paper width to an external device depending on an instruction of a control command sent by the external device or a setting of a software switch or a hardware switch.

8. The printing device described in claim 1, wherein:

the paper guide sensor detects the installation position of the paper guide when the paper guide is engaged with an engaging part of the storage compartment; and when the paper guide is disposed in the storage compartment but not engaged with the engaging part, and the cover moves from the open position to the closed position, the cover is pushed and the paper guide engages the engaging part.

9. The printing device described in claim 1, further comprising:

a conveyer that holds and conveys the roll paper between a thermal head and a platen roller, wherein the controller is configured to increase the torque of a motor that drives the platen roller as the paper width indicated by the setting decreases.

10. The printing device described in claim 1, wherein the controller, when causing the print mechanism to print a string, changes the number of character columns on one line according to the paper width indicated by the setting.

11. A printing device, comprising:

a print mechanism configured to print on roll paper having a width;

a storage compartment configured to hold the roll paper;

a paper guide that limits the position of the roll paper in the storage compartment;

a paper guide sensor configured to detect an installation position of the paper guide;

a nonvolatile memory configured to store a setting indicating a paper width of the roll paper and to store the setting even if the printing device is power off; and a controller configured to: determine whether the setting stored in the nonvolatile memory is different from a first paper width of the roll paper based on the installation position of the paper guide detected by the paper guide sensor; cause the print mechanism to print based on the setting stored in the nonvolatile memory even if the setting is different from the first paper width; and when the first paper width when the printing device is powered on is not the setting, rewrite the setting to the first paper width in the nonvolatile memory.

12. The printing device described in claim 11, wherein:

the controller is configured to not rewrite the setting regardless of the value of the setting when the paper guide is not installed.

13. The printing device described in claim 11, wherein:

the controller configured to report to a computer when the first paper width is different from the setting.

* * * * *